US010665964B2

(12) United States Patent
Myer et al.

(10) Patent No.: US 10,665,964 B2
(45) Date of Patent: May 26, 2020

(54) ELECTRICAL TERMINALS HAVING BI-DIRECTIONAL SERRATIONS AND METHOD OF MANUFACTURE

(71) Applicant: TE CONNECTIVITY CORPORATION, Berwyn, PA (US)

(72) Inventors: John Mark Myer, Millersville, PA (US); Steven Michael Harnish, Cleona, PA (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 16/034,584

(22) Filed: Jul. 13, 2018

(65) Prior Publication Data

US 2020/0021042 A1 Jan. 16, 2020

(51) Int. Cl.
*H01R 4/20* (2006.01)
*H01R 4/18* (2006.01)

(52) U.S. Cl.
CPC ..... *H01R 4/184* (2013.01)

(58) Field of Classification Search
CPC ..... H01R 4/20
USPC ..... 174/84 C; 439/877
See application file for complete search history.

(56) References Cited

U.S. PATENT DOCUMENTS 3,736,627 A * 6/1973 Sosinski ..... H01R 4/2495 24/23 W
3,812,448 A * 5/1974 Haitmanek ..... H01R 4/18 439/421
3,990,143 A 11/1976 Dittmann et al.
4,003,623 A * 1/1977 Reynolds ..... H01R 4/188 439/395
6,056,605 A * 5/2000 Nguyen ..... H01R 4/188 439/877
7,462,062 B2 * 12/2008 Kumakura ..... H01R 4/182 439/422
8,303,354 B2 * 11/2012 Ootsuka ..... H01R 4/188 439/877
8,622,774 B2 * 1/2014 Seifert ..... H01R 4/185 439/882

(Continued)

FOREIGN PATENT DOCUMENTS

EP 2546931 A1 1/2013
GB 1482831 A 8/1977

OTHER PUBLICATIONS

Extended Search Report, International Application No., 19186025.3, International Filing Date, Jul. 12, 2019.

*Primary Examiner* — Chau N Nguyen

(57) ABSTRACT

An electrical terminal and method for electrically and mechanically terminating to an electrical conductor. A plurality of first recesses is positioned in a termination section, with a plurality of first ridges provided proximate the first recesses. A plurality of second recesses is positioned in the termination section. A plurality of second ridges is provided proximate the second recesses, with the second ridges extending in a direction which is parallel to the plurality of second recesses. A plurality of serrations is formed between the plurality of first recesses and the plurality of second recesses. The plurality of serrations has sharp burrs which interact with the electrical conductor to remove oxides on the electrical conductor to establish mechanical and electrical contact areas between the burrs and the electrical conductor.

18 Claims, 4 Drawing Sheets

(56) References Cited

U.S. PATENT DOCUMENTS

| | | | | |
|---|---|---|---|---|
| 8,979,601 | B2 | 3/2015 | Schmidt et al. | |
| 9,209,615 | B2 | 12/2015 | Ono et al. | |
| 9,252,505 | B2 | 2/2016 | Otsuka et al. | |
| 9,509,085 | B2 | 11/2016 | Morikawa | |
| 2015/0188244 | A1* | 7/2015 | Yoshioka ..... | H01M 2/20<br>439/442 |

* cited by examiner

ELECTRICAL TERMINALS HAVING BI-DIRECTIONAL SERRATIONS AND METHOD OF MANUFACTURE

FIELD OF THE INVENTION

The invention is directed to electrical terminals with bi-directional serrations for improved crimp performance. Further, the invention is directed to a method of manufacturing the bi-directional serrations.

BACKGROUND OF THE INVENTION

Electrical conductors are frequently terminated at their free ends with connection pieces which permit contacting of the conductor with corresponding contact partners. For this, inter alia connecting terminals are used which permit solder-free connection to the conductor structure. These terminals, which are also known as crimp connection terminals, are typically manufactured from a metal sheet by means of a punching process. In such case, a conductor-side section of the connecting terminal has at least one tab which is bent around the conductor and then is crimped therewith for the purposes of mechanical and/or electrical connection. In the case of electrical conductor structures which are coated with an insulating layer, such as a thin enamel layer or a parasitic oxide layer, the disturbing insulating layer must be removed or broken through to produce sufficient electrical contact between the connecting terminal and conductor structure. Connecting terminals in which the surface which contacts the conductor has special sharp-edged serration structures are used for this. Upon crimping of the connecting terminal, the parasitic insulating layer is broken through by the serration structures cutting into the metallic conductor. By means of appropriate crimping, good extension and associated galling of the materials involved is permitted, which in turn achieves good electrical contacting. The transition resistances prove to be stable long-term over the lifetime, in particular for aluminum conductors and hard copper conductors with small cross-sections.

The use of sharp-edged serrations, however, also leads to undesirable mechanical weakening of the relevant conductor, since the conductor cross-section is reduced at the relevant points by the serration structures cutting in. This effect proves particularly harmful in the case of conductors made from brittle materials, such as aluminum. Further, the use of such a connecting terminal may also be unfavorable in the case of conductors which are constructed from a plurality of thin strands. In this case, the sharp-edged serrations can cause severing of individual conductor strands.

A conventional connecting terminal is typically produced by means of a punching process, the serrations in a subsequent "ploughing" process being produced outside the punch. In this process, a plurality of knife-like "ploughing" structures arranged next to one another are drawn across the conductor contact surface of the connecting terminal transversely to the direction of insertion of the cable, to produce groove-like structures with symmetrical heapings of material.

Good electrical crimp performance in a stamped and formed terminal requires clean metal to metal contact between the terminal wire barrel and the wire strands. Serrations are typically stamped inside the wire barrel with the intention of generating sharp edges which can scrape through the oxides on the outside of the wire strands during the crimping process to produce these clean areas of metal to metal contact. Some terminals made from soft or thick materials can make it difficult to generate the desired sharp edges with only one hit of a serration punch since the soft and thick material simply pushes out of the way of the serration punch instead of flowing into the punch and taking on the intended shape.

It is, therefore, an object of the invention to provide an electric terminal which permits both sufficient electrical connection and sufficient mechanical connection between the connecting terminal and conductor and, in addition, is inexpensive to produce.

SUMMARY OF THE INVENTION

An embodiment is directed to an electrical terminal for electrically and mechanically terminating to an electrical conductor. The electrical terminal includes an electrical conductor termination section. A plurality of first recesses are positioned in the termination section, with a plurality of first ridges provided proximate the first recesses. The first ridges extend in a direction which is parallel to the plurality of first recesses. A plurality of second recesses are positioned in the termination section. The plurality of second recesses extend in a direction which is not parallel to the plurality of first recesses. A plurality of second ridges is provided proximate the second recesses, with the second ridges extending in a direction which is parallel to the plurality of second recesses. A plurality of serrations are formed between the plurality of first recesses and the plurality of second recesses. The plurality of serrations have sharp burrs which interact with the electrical conductor to remove oxides on the electrical conductor to establish mechanical and electrical contact areas between the burrs and the electrical conductor.

An embodiment is directed to an electrical terminal for electrically and mechanically terminating to an electrical conductor. The electrical terminal includes an electrical conductor termination section. A plurality of first recesses is positioned in the termination section. A plurality of first ridges is provided proximate the first recesses. A plurality of second recesses is positioned in the termination section. A plurality of second ridges is provided proximate the second recesses. The plurality of second recess and the plurality second ridges have a plurality of portions, the plurality of portions having different profiles. A plurality of serrations is formed between the plurality of first recesses and the plurality of second recesses. The plurality of serrations has different profiles in each of the respective plurality of portions, with at least one respective plurality of portions having sharp burrs at the intersections of the first ridges and the second ridges, the plurality of burrs interacts with the electrical conductor to remove oxides on the electrical conductor to establish mechanical and electrical contact areas between the burrs and the electrical conductor.

An embodiment is directed to a method of manufacturing an electrical terminal for electrically and mechanically terminating to an electrical conductor. The method includes: forming a plurality of first recesses in a termination section of the electrical terminal, producing a plurality of first ridges; forming a plurality of second recesses in the termination section of the electrical terminal, producing a plurality of second ridges, the plurality of second recesses extending in a direction which is not parallel to the plurality of first recesses; and forming a plurality of serrations between the plurality of first recesses and the plurality of second recesses, the plurality of serrations having sharp burrs at the intersections of the first ridges and the second ridges, the plurality of burrs interact with the electrical conductor to establish mechanical and electrical contact areas between the burrs and the electrical conductor.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
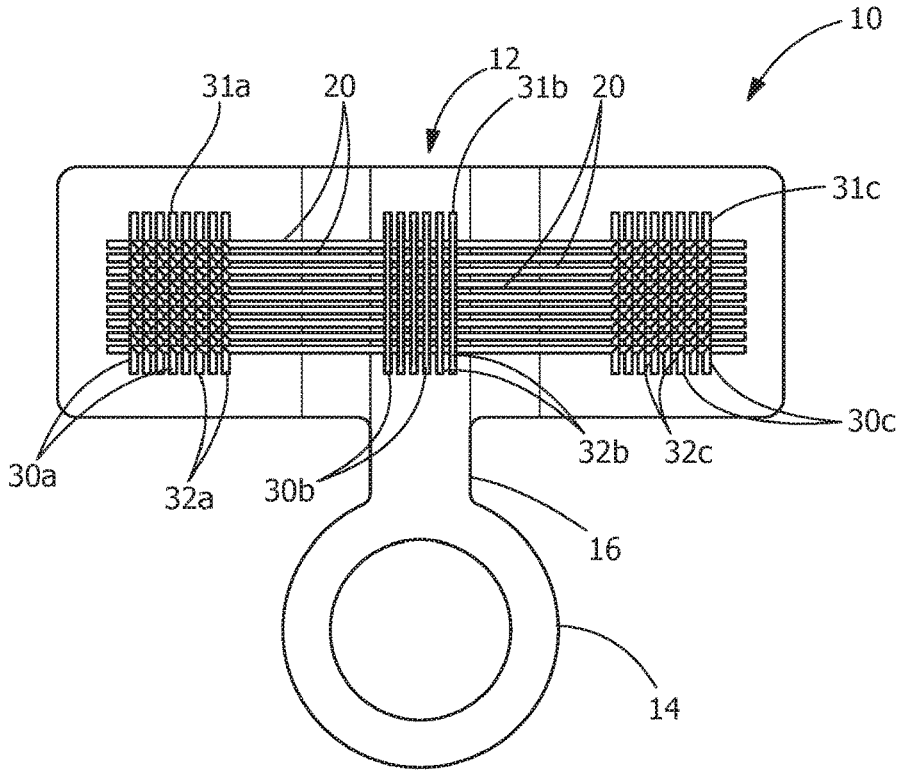
FIG. 1 is a top view of stamped electrical terminal, prior to being formed, with bi-directional serrations for improved crimp performance according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 2:
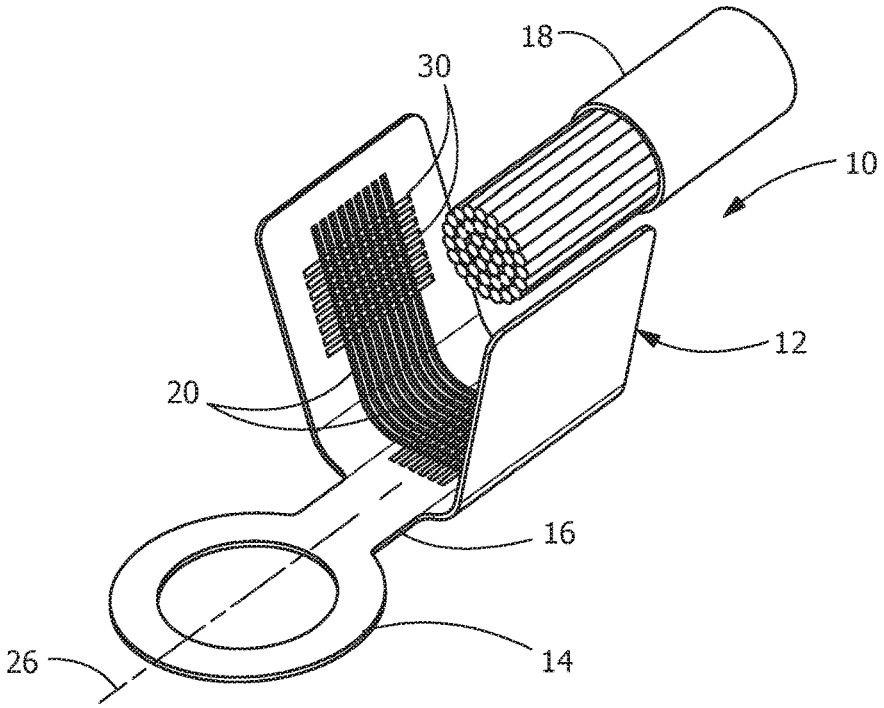
FIG. 2 is a perspective view of the formed electrical terminal with bi-directional serrations for improved crimp performance according to the present invention.

FIGS. 1 and 2 illustrate an illustrative embodiment of an electrical terminal 10 which has an electrical conductor termination section 12 for electrically and mechanically terminating to an electrical conductor 18, such as, but not limited to, stranded wire. In the embodiment shown, the terminal 10 includes the conductor termination section 12 and a mating section 14, which in the illustrative embodiment is a pole shoe. However, other embodiments of the electrical terminal 10, the conductor termination section 12 and the mating section 14 may be used without departing from the scope of the invention. The two sections 12, 14 are connected together via a common bridge section 16.

Figure 5:
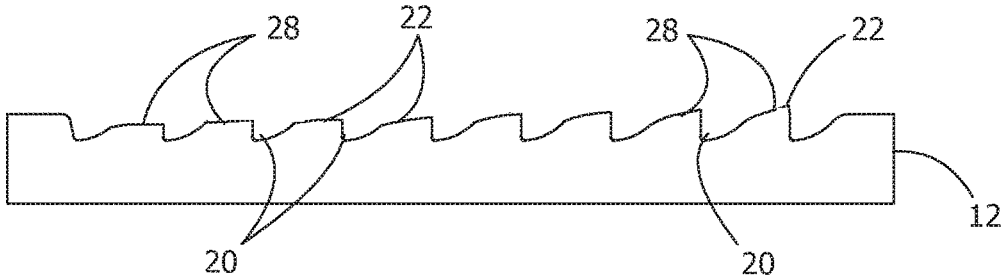
FIG. 5 is a side view of the terminal after the first embossing operation, with the first serrations provided on the terminal.

As best shown in FIGS. 1, 2 and 5, the electrical conductor termination section 12 has a plurality of first recesses or grooves 20 and a plurality of first ridges 22 provided proximate the first recesses 20. In one exemplary embodiment, the plurality of first recesses 20 extends in a direction which is transverse to a longitudinal axis 26 of the electrical terminal 10. The first ridges 22 extend in a direction which is parallel to the plurality of first recesses 20, for example in a direction which is transverse to the longitudinal axis 26 of the electrical terminal 10. In one illustrative embodiment, the first recesses 20 and the first ridges 22 extend transversely to the direction of insertion of the electrical conductor 18.

Figure 8:
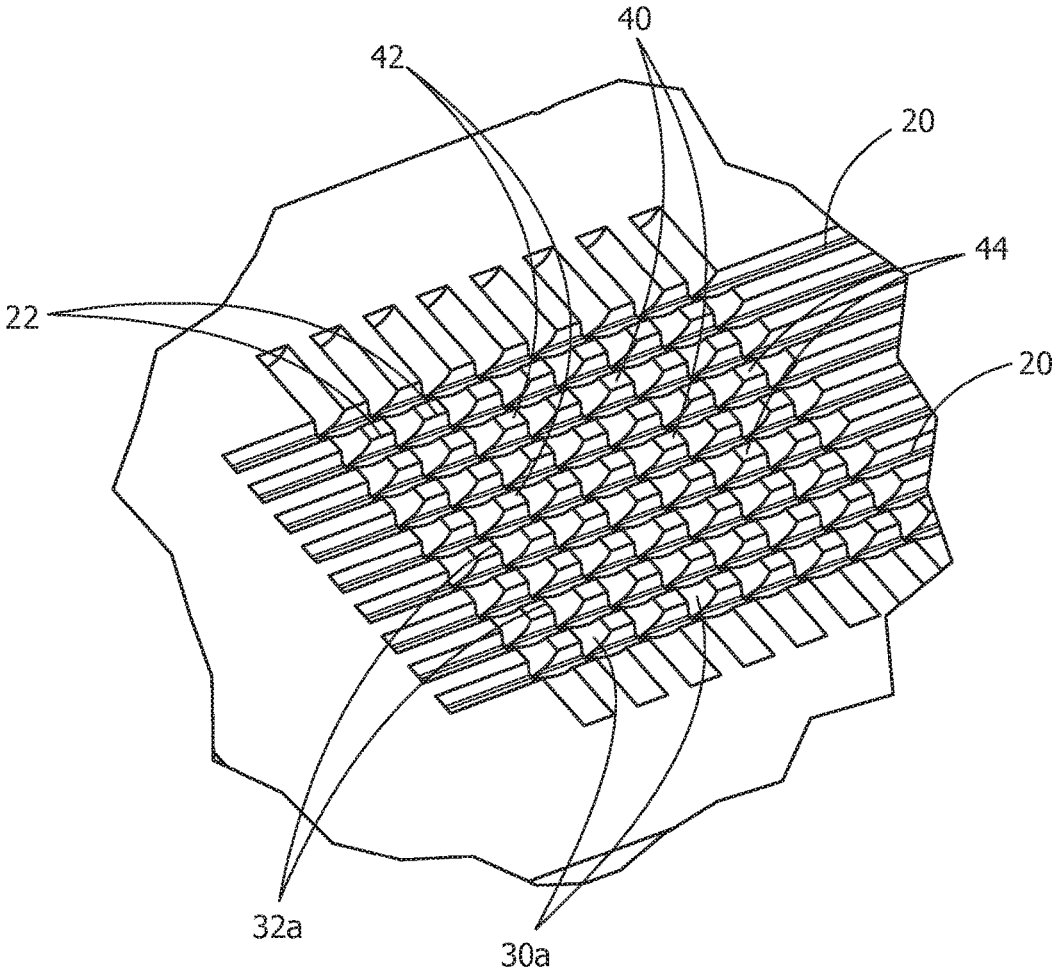
FIG. 8 is a perspective view of the terminal after the second embossing operation, with the first and second serrations provided on the terminal.

As best shown in FIGS. 1, 2 and 8, the electrical conductor termination section 12 has a plurality of second recesses or grooves 30 and a plurality of second ridges 32 provided proximate the second recesses 30. The plurality of second recesses 30 extends in a direction which is not parallel to the plurality of first recesses 20, for example in a direction which is parallel to the longitudinal axis 26 of the electrical terminal 10. The second ridges 32 extend in a direction which is parallel to the plurality of second recesses, for example, in a direction which is parallel to the longitudinal axis 26 of the electrical terminal 10. In one illustrative embodiment, the second recesses 30 and the second ridges 32 extend inline to the direction of insertion of the electrical conductor 18.

As shown in FIG. 8, a plurality of serrations 40 is formed between the plurality of first recesses 20 and the plurality of second recesses 30. The plurality of serrations 40 having sharp burrs 42 which interact with the electrical conductor 18 to establish mechanical and electrical contact areas 44 between the burrs 42 of the serrations 40 and the electrical conductor 18. In various illustrative embodiments, the burrs 42 of the serrations 40 engage electrical conductor 18 and facilitate the removal of oxides on the electrical conductor 18 to establish a positive electrical engagement between the burrs 42 of the serrations 40 and the electrical conductor 18.

Although the serrations 40 shown in the illustrative embodiment extend only partially across the entire breadth of the electrical conductor termination section 12 of the terminal 10, serrations 40 which extend over the entire breadth of the electrical conductor termination section 12 are also possible, depending on the application. In addition, while the serrations 40 are shown only on the electrical conductor termination section 12 in the illustrative embodiment, the serrations 40 may be provided on other portions of the terminal 10.

Figure 3:
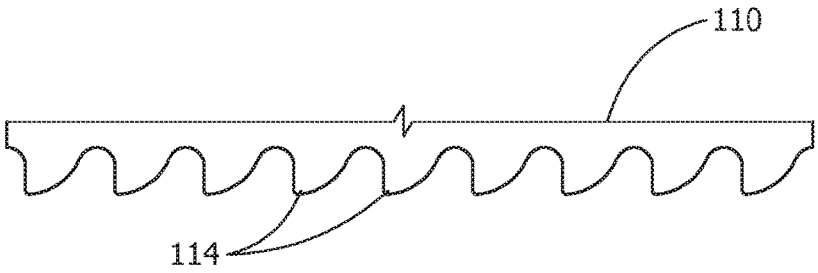
FIG. 3 is a side view of a first embossing die with shark-fin-shaped serration structures.

The method of manufacturing the terminal 10, as described above, is illustrated in FIGS. 3 through 7. With the terminal 10 cut from a metal blank, the terminal 10 is moved to a first embossing die punch 110. The first embossing die 110, as shown in FIG. 3, has a plurality of embossing structures or teeth 114 which are in the form of serrations arranged in a groove shape. In the embodiment shown, the embossing structures or teeth 114 are shark-fin-shaped and extend in the same direction. However, other shapes and configurations can be used. For example, the embossing structures or teeth 114 may have two sections which extend in different directions to provide mirror-symmetry to each other. In other examples, the first embossing die 110 may have two or more sections with embossing structures or teeth 114 of different configurations.

Figure 4:
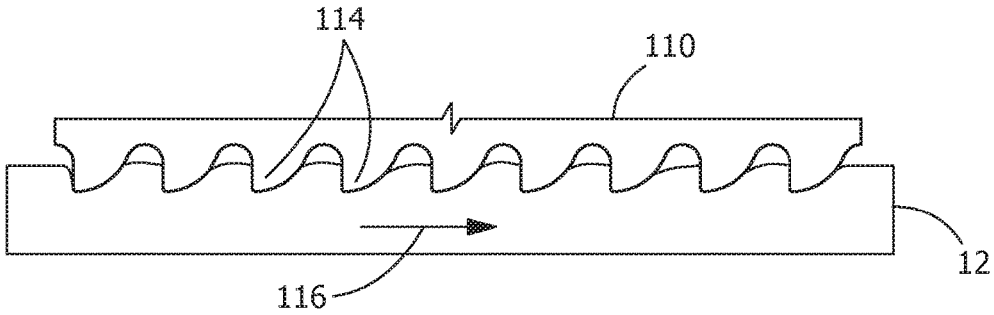
FIG. 4 is a side view of the first embossing die engaging the metal for the terminal during the first embossing operation to form first serrations.

Referring to FIGS. 3 through 5, the operation of the first embossing die 110 is shown. The first embossing die 110 is lowered from the position shown in FIG. 3 to the position shown in FIG. 4. As this occurs, the embossing structures 114 of the first embossing die 110 are pressed into a contact surface 28 of the electrical conductor termination section 12 of the punched terminal 10.

Due to the asymmetrical construction of the serration-shaped embossing structures 114, the two flanks of the embossing structures 114 have different angles of inclination, the material of the contact surface 28 is displaced to different extents by the two flanks. The shark-fin-shaped embossing structures 114 have a substantially perpendicular left flank. In contrast, the right flank of the embossing structures 114 is formed with an S-shaped contour. Due to the flow of material in the direction of insertion (arrow 116), material is pressed effectively against the steep left flank of the embossing structures 114 and raised up on this flank. The movement of the material thus produced forms the first recesses 20 and the first ridges 22. The first ridges 22 are formed to have sharp-edges, the height or sharpness of which increases from left to right owing to the flow of material, represented by means of the arrow 116.

As is shown in FIG. 4, a flow of material which is directed towards the right is brought about upon pressing the embossing structures 114 into the terminal 10. This causes the material to be raised up on the steep flanks of the teeth in the interstitial spaces. Due to the flow of material, indicated by means of the arrow 116, in the terminal 10, once the embossing process has ended, there is more material on the right side than on the left side of the terminal 10. Consequently, the material formed by the right flank is higher than the material formed by the left flank, resulting in the first ridges 22 being formed by the right flank.

As shown in FIG. 5, the higher first ridges 22 on the right side also brings about a more acute or sharper profile of the relevant serration structures, since the material rises higher here. Thus, the sharpness of the serrations formed by the first embossing die increases from left to right in a gradient shape.

In alternative embodiments, wedge-shaped embossing structures with a flatter right flank and a perpendicular left flank may be used. In such embodiments, the flatter right flank of the embossing structures pushes the material effectively to the left, whereas the preferably perpendicular left flank of the embossing structures does not cause any substantial displacement of material in the terminal. Owing to its larger displacement volume, the use of shark-fin-shaped embossing structures 114 means that a greater flow of material can be induced in the workpiece than is the case with the aid of wedge-shaped embossing structures. Consequently, by varying the flank profile, the flow of material may be adapted or tailored the respective applications.

Once the first embossing has taken place, the first embossing die 110 is raised again in order to release the terminal 10. As shown in FIG. 5, the terminal 10 now has the first recesses 20 and the first ridges 22, with sharper-edges increasing in a gradient shape from left to right.

Figure 6:
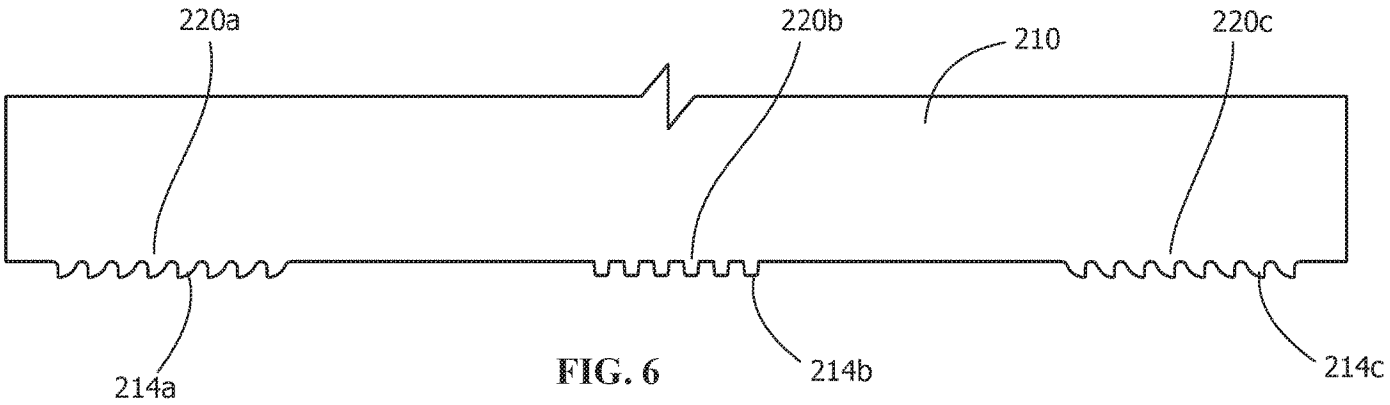
FIG. 6 is a side view of a second embossing die with different shaped serration structures in different areas.
Figure 7:
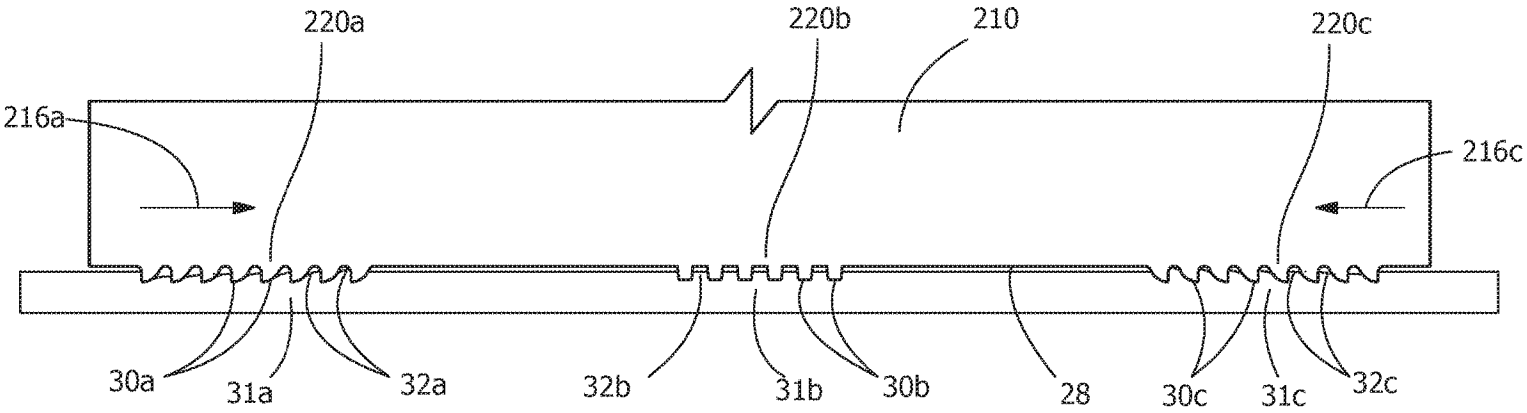
FIG. 7 is a side view of the second embossing die engaging the metal for the terminal during the second embossing operation to form second serrations.

Referring to FIGS. 6 through 8, the operation of the second embossing die 210 is shown. As second embossing die 210 is lowered from the position shown in FIG. 6 to the position shown in FIG. 7. As this occurs, the embossing structures 214 of the second embossing die 210 are pressed into the contact surface 28 of the electrical conductor termination section 12 of the punched terminal 10 which has been stamped with the first recesses 20 and first ridges 22.

The embossing structures 214 of the second embossing die 210 have three sections 220*a*, 220*b*, 220*c*. The first section 220*a* has shark-fin-shaped embossing structures 214*a* with a substantially perpendicular left flank and a right flank formed with an S-shaped contour. The third section 220*c* has shark-fin-shaped embossing structures 214*c* with a substantially perpendicular right flank and a left flank formed with an S-shaped contour. The second section 220*b* is provided between the first section 220*a* and the third section 220*c*. The second section 220*b* has trapezoidal embossing structures 214*b*.

Due to the construction of the embossing structures 214, the material of the contact surface 28 is displaced to different extents by the different embossing structures 214*a*, 214*b*, 214*c* to keep the terminal section 12 of the terminal 10 more symmetrical. As best shown in FIGS. 1 and 8, the second section 220*b* with the trapezoidal embossing structures 214*b* is used to stamp the center set or second portion 31*b* of second recesses 30*b* and second ridges 32*b* which are positioned at the bottom of the wire barrel or terminal section 12 when the terminal 10 is properly formed. The first section 220*a* with the shark-fin-shaped embossing structures 214*a* is used to stamp the left set or first portion 31*a* of second recesses 30*a* and second ridges 32*a* which are positioned on the left vertical leg of the wire barrel or terminal section 12 when the terminal 10 is properly formed. The third section 220*c* with the shark-fin-shaped embossing structures 214*c* is used to stamp the right set or third portion 31*c* of second recesses 30*c* and second ridges 32*c* which are positioned on the right vertical leg of the wire barrel or terminal section 12 when the terminal 10 is properly formed. The three separate sections 220*a*, 220*b*, 220*c* with three separate embossing structures 214*a*, 214*b*, 214*c* ensure that the height of the axial second hit ridges 32*b* at the bend radius at the bottom corners of the wire barrel or termination section 12 of the terminal 10 will be controlled or minimized so the material does not fracture when the termination section 12 of the terminal 10 is crimped, which generates a tight corner radius.

As the second embossing die 210 is moved to the position shown in FIG. 7, the embossing structures 214 move the material of the contact surface 28. The first section 220*a* causes the material to move toward the second section 220*b* to produce the first portion 31*a* with the second recesses 30*a* and the second ridges 32*a*. The second ridges 32*a* are formed to have sharp-edges, the height or sharpness of which increases toward the second section 220*b* owing to the flow of material, represented by means of the arrow 216*a*. The third section 220*c* causes the material to move toward the second section 220*b* to produce the third portion 31*c* with the second recesses 30*c* and the second ridges 32*c*. The second ridges 32*c* are formed to have sharp-edges, the height or sharpness of which increases toward the second section 220*b* owing to the flow of material, represented by means of the arrow 216*c*. Due to the shape of the embossing structures 214*b*, the second section 220*b* forms the second portion 31*b* with uniform second recesses 30*b* and second ridges 32*b*.

As shown in FIG. 7, the higher second ridges 22*a*, 22*c* brings about a more acute or sharper profile of the relevant serration structures, since the material rises higher here.

In alternative embodiments, other configurations of the embossing structures 214 may be used. For example, wedge-shaped embossing structures with a flatter right/left flank and a perpendicular left/right flank may be used. In other examples, the first embossing structures 214*a*, the second embossing structures 214*b* and the third embossing structures 214*c* may all have the same configuration. Consequently, by varying the flank profile, the flow of material may be adapted or tailored the respective applications.

Once the second embossing has taken place, the second embossing die 210 is raised again in order to release the terminal 10. As shown in FIG. 8, the terminal 10 now has the first recesses 20, first ridges 22, second recesses 30 and second ridges 32. As the first ridges 22 have sharper-edges increasing in a gradient shape from left to right, and as the second ridges have varying edge sharpness, the serrations formed across the contact surface 28 of the wire barrel or termination section 12 of the terminal 10 are varied and controlled.

Upon the crimping of a connecting terminal 10 which is configured in this manner with a conductor structure, the serration structures comprised of the first ridges 22 and the second ridges 32*a*, 32*b* on the right vertical leg and the base penetrate only relatively slightly into the conductor core, so that the conductor structure at this point is not excessively mechanically weakened. The serration structures comprised of first ridges 22 and the second ridges 32*a*, 32*b* on the right vertical leg and the base therefore contribute primarily to the mechanical fastening of the conductor structure within the terminal 10, and less to the production of a sufficient electrical contact between the terminal 10 and conductor.

On the other hand, the serration structures comprised of the first ridges 22 and the second ridges 32*c* on the left vertical leg, owing to the relatively higher heapings of material and the associated sharper-edged ridges, penetrate further into the conductor, resulting in a particularly good electrical connection between the connecting terminal 10 and the conductor.

The purpose of this invention is to provide a means by which to generate a multitude of sharp edges inside the wire crimp barrel by hitting the wire barrel a first time to generate a series of parallel ridges and then hitting a second time with a second serration punch which has the serrations running at an angle relative (for example, in a direction perpendicular) to the serrations formed by the first serration punch. As the second punch hits the series of parallel ridges formed by the first serration punch, the material is pushed out of the way, forming a series of sharp burrs running across the wire barrel at the leading and trailing edges of the parallel ridges. Due to the angled shape of the second punch, the material also flows within each ridge in a direction perpendicular to the first hit such at an angle relative (for example, in a direction perpendicular) to the ridges such that the shark fin shape is now generated in both directions on the serrations. Note that the second hit is typically not as deep as the first hit, so the sharp burrs generated at the leading and trailing edges of the original ridges are at an optimal depth to interact with the wire strands and scrape off oxides to establish clean metal to metal contact areas inside the crimp barrel. For example, in an illustrative embodiment, the first hit with the first embossing die provides recesses which are approximately 0.24 mm deep and the second hit with the second embossing die provides recesses which are approximately 0.18 mm deep. Also note that the perpendicular serrations on the second punch could be separated into three or more separate cross-serration regions. For example, as shown in FIG. 8, the perpendicular serrations could possibly not be placed at the bottom corners of the crimp barrel to avoid any inclination for cracking during the crimping process due to the serration grooves running along the axis of the wire in the same direction as the bend in the bottom corners of the crimp.

The first serration punch is necessary to produce a series of free standing parallel ridges running across the width of the wire barrel. Because these parallel ridges are now free formed and not confined by a metal punch, it is possible to hit them a second time with a second perpendicular punch with serrations running in a perpendicular direction to generate a series of burrs along the leading and trailing edges of the original parallel ridges. These burrs would be impossible to form with one hit of one punch because there would be no cleared out area along the leading and trailing sides of the ridges for the burrs to form into if the ridges were contained by a punch during a single hit. Also, the angled shape of the second punch can generate an additional series of sharp edges by bisecting the original ridges and flowing the material along each ridge to form the shape of a shark fin.

While the invention has been described with reference to a preferred embodiment, it will be understood by those skilled in the art that various changes may be made, and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical terminal for electrically and mechanically terminating to an electrical conductor, the electrical terminal comprising:

an electrical conductor termination section;

a plurality of first recesses positioned in the termination section, a plurality of first ridges provided proximate the first recesses, the first ridges extending in a direction which is parallel to the plurality of first recesses, the plurality of first ridges have sharp-edges, the height or sharpness of which increases in a gradient shape from one side of the electrical conductor termination section to the other side of the electrical conductor termination section;

a plurality of second recesses positioned in the termination section, the plurality of second recesses extending in a direction which is not parallel to the plurality of first recesses, a plurality of second ridges provided proximate the second recesses, the second ridges extending in a direction which is parallel to the plurality of second recesses;

the plurality of first recesses has a first depth and the plurality of second recesses has a second depth, the first depth being greater than the second depth;

a plurality of serrations formed between the plurality of first recesses and the plurality of second recesses, the plurality of serrations having sharp burrs which interact with the electrical conductor to remove oxides on the electrical conductor to establish mechanical and electrical contact areas between the burrs and the electrical conductor.

2. The electrical terminal as recited in claim 1, wherein the plurality of first recesses extend in a direction which is perpendicular to a longitudinal axis of the electrical terminal.

3. The electrical terminal as recited in claim 2, wherein the plurality of second recesses extend in a direction which is parallel to the longitudinal axis of the electrical terminal.

4. The electrical terminal as recited in claim 1, wherein the plurality of serrations extend across the entire width of the electrical conductor termination section.

5. The electrical terminal as recited in claim 1, wherein the plurality of serrations extends over a portion of the width of the electrical conductor termination section.

6. The electrical terminal as recited in claim 1, wherein the plurality of second recess and the plurality second ridges have a first portion, a second portion and a third portion, with the first portion, the second portion and the third portion having different profiles.

7. The electrical terminal as recited in claim 6, wherein the second recesses and second ridges of the second portion are positioned at a bottom of the electrical conductor termination section when the terminal is properly formed.

8. The electrical terminal as recited in claim 7, wherein the second recesses and second ridges of the first portion are positioned on a first vertical leg of the electrical conductor termination section when the terminal is properly formed.

9. The electrical terminal as recited in claim 8, wherein the second recesses and second ridges of the third portion are positioned on a second vertical leg of the electrical conductor termination section when the terminal is properly formed.

10. The electrical terminal as recited in claim 6, wherein the second ridges of the first portion are formed to have sharp-edges, the height or sharpness of which increases toward the second portion.

11. The electrical terminal as recited in claim 10, wherein the second ridges of the third portion are formed to have sharp-edges, the height or sharpness of which increases toward the second portion.

12. The electrical terminal as recited in claim 11, wherein the second ridges of the second portion are formed to have edges, the height or sharpness of which is uniform between the first portion and the second portion.

13. The electrical terminal as recited in claim 11, wherein the height or sharpness of the second portion is less than the height or sharpness of the first and third portions.

14. The electrical terminal as recited in claim 1, wherein the plurality of first recess is between 0.20 mm and 0.30 mm in depth and the plurality of second recess is between 0.15 mm and 0.20 mm in depth.

15. An electrical terminal for electrically and mechanically terminating to an electrical conductor, the electrical terminal comprising:

an electrical conductor termination section;

a plurality of first recesses positioned in the termination section, a plurality of first ridges provided proximate the first recesses;

a plurality of second recesses positioned in the termination section, the plurality of second recesses extending in a direction which is not parallel to the plurality of first recesses, a plurality of second ridges provided proximate the second recesses;

the plurality of first recesses has a first depth and the plurality of second recesses has a second depth, the first depth being greater than the second depth;

the plurality of second recess and the plurality second ridges have a plurality of portions, the plurality of portions having different profiles;

a plurality of serrations formed between the plurality of first recesses and the plurality of second recesses, the plurality of serrations having different profiles in each of the respective plurality of portions, with at least one respective plurality of portions having sharp burrs at the intersections of the first ridges and the second ridges, the plurality of burrs interact with the electrical conductor to remove oxides on the electrical conductor to establish mechanical and electrical contact areas between the burrs and the electrical conductor.

16. The electrical terminal as recited in claim 15, wherein the plurality of first recesses extend in a direction which is transverse to the direction of insertion of the electrical conductor.

17. The electrical terminal as recited in claim 15, wherein the plurality of second recesses extend in a direction which is in line to the direction of insertion of the electrical conductor.

18. A method of manufacturing an electrical terminal for electrically and mechanically terminating to an electrical conductor, the method comprising:

forming a plurality of first recesses in a termination section of the electrical terminal at a first depth, producing a plurality of first ridges;

forming a plurality of second recesses in the termination section of the electrical terminal at a second depth, the second depth being less than the first depth, producing a plurality of second ridges, the plurality of second recesses extending in a direction which is not parallel to the plurality of first recesses;

forming a plurality of serrations between the plurality of first recesses and the plurality of second recesses, the plurality of serrations having sharp burrs at the intersections of the first ridges and the second ridges, the plurality of burrs interact with the electrical conductor to establish mechanical and electrical contact areas between the burrs and the electrical conductor;

forming the plurality of second recesses with a plurality of portions having different profiles to produce second ridges of different profiles in each of the plurality of portions.

* * * * *